US007234601B2

(12) United States Patent
Aspden

(10) Patent No.: US 7,234,601 B2
(45) Date of Patent: Jun. 26, 2007

(54) DISPLAY ORGANIZER

(76) Inventor: Kathy A. Aspden, P.O. Box 594, Marstons Mills, MA (US) 02648-0594

( * ) Notice: Subject to any disclaimer, the term of this patent is extended or adjusted under 35 U.S.C. 154(b) by 112 days.

(21) Appl. No.: 11/101,205

(22) Filed: Apr. 7, 2005

(65) Prior Publication Data

US 2005/0230329 A1 Oct. 20, 2005

Related U.S. Application Data

(60) Provisional application No. 60/562,439, filed on Apr. 15, 2004.

(51) Int. Cl.
*B42F 17/00* (2006.01)

(52) U.S. Cl. ..... 211/10; 206/232; 206/371; 206/443

(58) Field of Classification Search ..... 211/10, 211/11, 126.13; 40/371, 491, 124.2, 649, 40/654.01; 206/443, 232, 371
See application file for complete search history.

(56) References Cited

U.S. PATENT DOCUMENTS

| | | | | |
|---|---|---|---|---|
| 4,034,496 | A | 7/1977 | Cohen | |
| 4,152,831 | A | 5/1979 | Davies | |
| D265,867 | S | 8/1982 | Margulis | |
| 4,463,848 | A * | 8/1984 | Parker | 206/214 |
| 4,512,503 | A * | 4/1985 | Gioso | 224/539 |
| 4,837,953 | A | 6/1989 | Tannenbaum | |
| 4,898,281 | A | 2/1990 | Cherry | |
| 4,919,276 | A * | 4/1990 | Kim et al. | 211/126.14 |
| 5,080,315 | A * | 1/1992 | Tucker-Schafer | 248/441.1 |
| 5,301,856 | A * | 4/1994 | Newsome | 224/312 |
| D351,048 | S | 9/1994 | Gaynor | |
| 5,377,850 | A * | 1/1995 | Liaw | 211/163 |
| 5,421,498 | A | 6/1995 | Menoni | |
| 5,487,466 | A * | 1/1996 | Robson | 206/214 |
| 5,502,912 | A | 4/1996 | LeBoff et al. | |
| 5,657,880 | A * | 8/1997 | Birnbaum | 211/50 |
| 5,743,415 | A | 4/1998 | Smart | |
| 5,743,450 | A | 4/1998 | Plate | |
| 5,917,694 | A | 6/1999 | Denny | |
| 6,084,211 | A | 7/2000 | Bauer | |
| 6,092,672 | A * | 7/2000 | Harris et al. | 211/11 |
| D430,728 | S | 9/2000 | Horvath et al. | |
| 6,230,888 | B1 | 5/2001 | Frieze et al. | |
| 6,256,914 | B1 | 7/2001 | Yeh | |
| 6,305,388 | B1 | 10/2001 | Zeller | |
| 6,336,555 | B1 | 1/2002 | Breeden | |
| 6,343,699 | B1 * | 2/2002 | DeCarlo et al. | 211/11 |

(Continued)

*Primary Examiner*—Jennifer E. Novosad
(74) *Attorney, Agent, or Firm*—Leslie Meyer-Leon, Esq.; IP Legal Strategies Group P.C.

(57) ABSTRACT

The invention addresses the needs of a professional service provider to organize and display items at or on his or her work stations that are of both a personal and professional nature, in a manner that is compact, efficient, and tidy. The apparatus includes a substantially rigid frame having a plurality of openings and/or receptacles which are adapted to receive objects, for example, scissors or shears, pens, pencils, or a pad of note paper, as well as an assortment of optional holders adapted to receive and display, for example, business cards, a professional license, professional announcements and fee schedules. The device further includes an externally accessible media storage sleeve configured for viewable display of a flat media display item, for example a photograph.

22 Claims, 6 Drawing Sheets

U.S. PATENT DOCUMENTS 6,390,293 B1 * 5/2002 Page et al. ..... 206/225
D467,390 S 12/2002 Lewis
6,523,704 B2 2/2003 Sanders
6,531,208 B2 3/2003 Chung
6,601,813 B1 8/2003 Kager et al.
6,665,970 B1 12/2003 Yun
2002/0133995 A1 9/2002 Cress et al.

* cited by examiner

DISPLAY ORGANIZER

REFERENCE TO PRIOR APPLICATION

This application is based on and claims priority from U.S. Provisional Patent Application Ser. No. 60/562,439, filed Apr. 15, 2004, which is hereby incorporated by reference.

FIELD OF THE INVENTION

This invention relates to a compact device for use in a work area to organize professional tools and to display personal items such as photographs.

BACKGROUND OF THE INVENTION

It is fairly ubiquitous that workers not only like to keep a variety of useful tools and supplies within reach, but also like to personalize their work space by displaying personal items such as mementos and photographs of family and friends. For example, professional service providers have frequent need of such things as writing utensils and supplies, e.g., pens, pencils, note cards and pads, along with a readily available supply of business cards, fee schedules, and advertisements or brochures to market auxiliary products. No less profound is the need of those working long hours, often in impersonal, institutional environments, to surround themselves with pictures, photographs, and memorabilia that give the work space a more individual character.

It is no surprise, then, that the work stations of workers such as professional service providers commonly become cluttered with an eclectic mixture of professional tools, informational notes and reminders, certificates such as diplomas and licenses, and personal memorabilia such as photographs and drawings. In the case of a beautician, cosmetologist, or hair stylist, for example, such items become intermingled on work stations with an assortment of various types of scissors and shears for cutting hair. This then leads to inefficient use of the work space, and the surfaces of such work stations are difficult to keep clean and can make a bad impression on clients and customers.

Although prior devices for organizing professional specialty tools are known to the art, none have met the fairly ubiquitous desire of most professional service providers to co-organize professional tools along with personal memorabilia, especially flat media such as photographs. Thus, workers are in need of a compact device that not only organizes and stores professional tools in an accessible manner, but also provides a tidy and efficient vehicle for the display of personal items such as photographs.

SUMMARY OF THE INVENTION

The invention features a display organizer that includes a frame having a substantially rigid shape, the frame including a top portion having a substantially horizontal surface, two side portions having side surfaces and supported structurally by the top portion, and an interior space at least partially confined by the top portion and two side portions. The frame also includes at least one opening in a limited area of the top portion, that is configured to receive and retrievably hold an object within the space (i.e., "interior space") that is defined dimensionally by the top portion and side portions of the frame. By "limited area" is meant that enough of the plane of the top portion remains to maintain the structural shape of and support for the side portions. The opening is configured so that a user has access to the object and can thereby retrieve the object from the display organizer. In addition, the display organizer of the invention features, on at least one of the side portions, an externally accessible media storage sleeve designed to provide viewable display of flat items such as paper or card items, or printed or photographic media.

Preferably, the display organizer of the invention rests stably on a flat surface, such as the surface of a workstation. This can be achieved by proper geometric alignment of the top and side portions, so that substantially planar alignment of the edges of the side portions allow the display organizer to rest stably on a flat surface. It is not essential, therefore, that the display organizer include an actual base element or bottom portion.

In other embodiments, the display organizer can further include an optional bottom portion, in which case the portion of the frame that includes the top and side portions is referred to herein as a 'top frame' and the portion of the frame that includes a base element is referred to as a 'bottom frame.' The base is preferably substantially planar, so as to allow the display organizer to rest stably on a flat surface. In yet another embodiment, the bottom frame can further include a substantially planar bottom portion attached to one or two end portions, each end portion attached to one of the two opposite ends of the bottom portion. One or both of the end portions can serve to support an upwardly open container mounted on at least one of the end portions.

As used herein, the terms "side," "end", "front", and "rear" are relative terms and are not intended to limit the invention. Features ascribed to 'side portions' can be easily applied to end portions and vice versa. The relative nature of such terms will be further understood to be consistent with the ability of a user to alter, e.g., rotate, the orientation and placement of the display organizer.

In one embodiment, the opening can be a receptacle opening, in which case the display organizer further includes a receptacle within the interior space in object receiving communication with the receptacle opening. The receptacle serves as a cup or container for holding objects, e.g., one or more writing instruments.

Alternatively, or in addition to, the opening can be an aperture configured to receive and hold an object within the interior space, the aperture further configured to support the object so as to maintain at least a portion of the object without the interior space, thereby enabling a user to easily grab the object and remove it from the display organizer. Preferably the object is held in a substantially upright position by the aperture, but it will be understood that an object resting against a side of the aperture can be in a tilted position. In cases in which the object has a handle portion, e.g., the handle of a pair of scissors or the handle of a letter opener, the opening can be configured to support the object so that the handle portion is accessible to the user from the outside of, e.g., from above, the display organizer.

In another embodiment, the display organizer of the invention can include at least one end portion attached to the top portion and two side portions. The end portion can be molded as part of the frame, e.g., as part of the top frame or as part of the bottom frame, or can be attached to the frame, e.g., attached by an adhesive, in which case the end portion can be attached to the top and side portions of the devise or, alternatively, can be attached to an optional bottom portion of the devise to form a "bottom frame", the end and bottom portions subsequently attached to the top frame.

The end portion of the device can serve as a template to support one or more containers, cups, or compartments for holding additional items in the organizer. For example, the upwardly open the container can be configured to receive and hold business cards.

The display organizer of the invention features, on at least one of the side portions, an externally accessible media storage sleeve designed to provide viewable display of flat items such as paper or card items, or printed or photographic media. The side portion can include a display surface portion and a back surface portion, the back surface portion extending from the display surface portion and turned back toward the interior space to define the storage sleeve between the display surface portion and the back surface portion. The storage sleeve can include at least one slot sized to accept the sliding entry or exit of a flat media display item. To facilitate view of the item within the sleeve, the storage sleeve can have an outer surface that is translucent or, preferably transparent, to the eye. The display item can be, e.g., a professional license or professional certificate, or can be a photograph or a postcard. The display item can also be an item for communicating professional services, e.g., a professional announcement of a professional schedule.

One embodiment of the present invention is shown in the accompanying drawings which, together with the description thereof, will serve to exemplify the invention. The particular structure illustrated can be modified by those skilled in the art without departing from the broad scope of the invention.

DETAILED DESCRIPTION OF THE INVENTION

The display organizer of the invention provides a system for assembling frequently used tools within immediate reach, parking equipment that is sensitive or expensive in a safe perch, while also providing a medium that is attractive and tidy for displaying personal memorabilia. The system thereby provides an efficient organizational system in a manner that balances the functional needs of the user with the esthetic and subjective need to personalize work space. A display organizer of the invention is useful in the work space of most types of workers, but is especially appropriate for use in the work areas of professional service providers, such as, without limitation, beauticians, hair stylists, draftsmen, and opticians.

By way of example, the embodiment shown in FIGS. 1–7 is directed to an organizing device that meets the needs of a hair stylist for organizing and displaying such items as, e.g., one or more pairs of scissors, a stack of business cards, plenty of pens and pencils, Post-Its® and/or a pad of paper, a protective sleeve for a display of a cosmetology license, and one or more favorite photographs.

Figure 1:
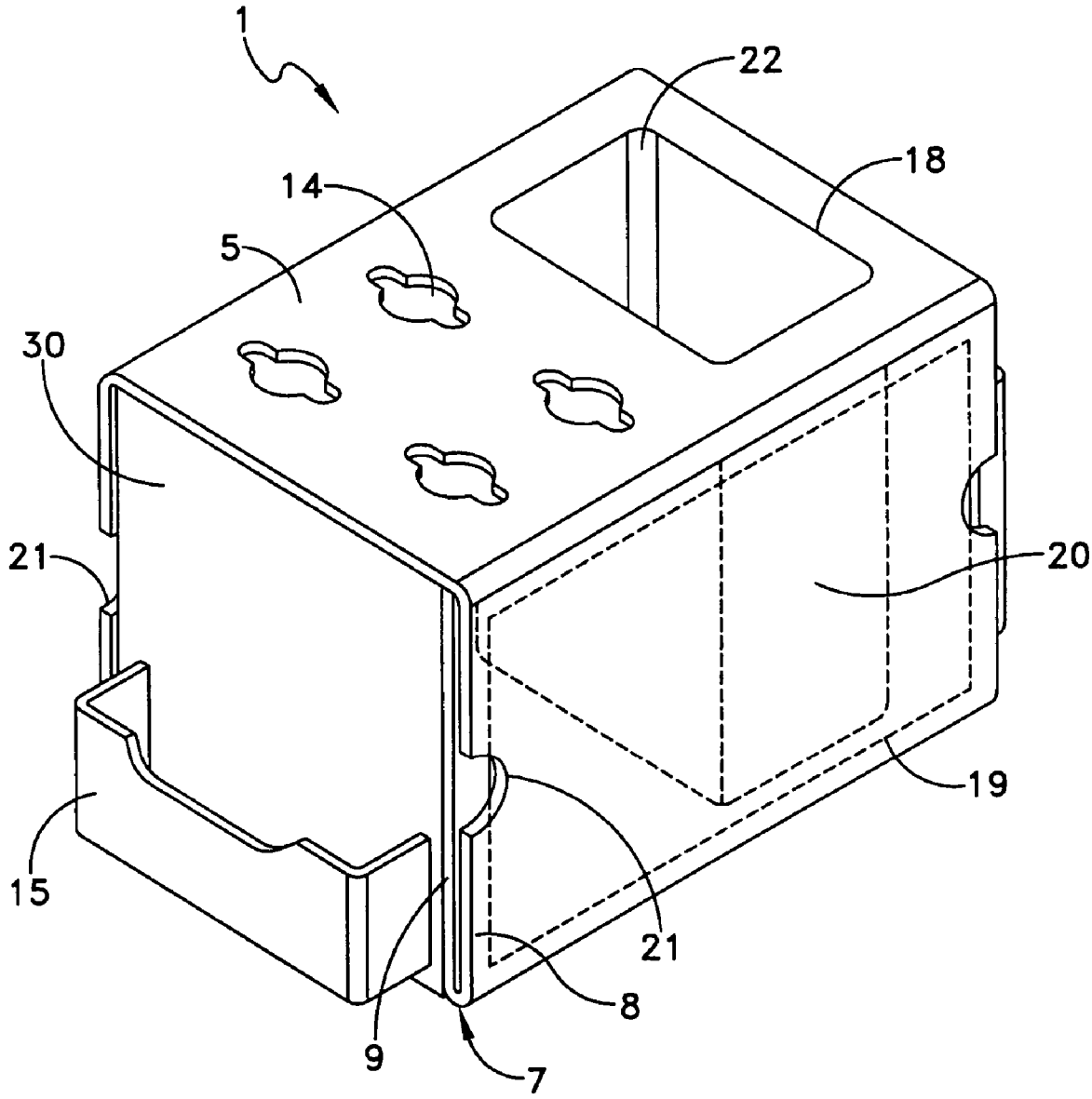
FIG. 1 is top front perspective view of an organizer device of the invention.
Figure 2:
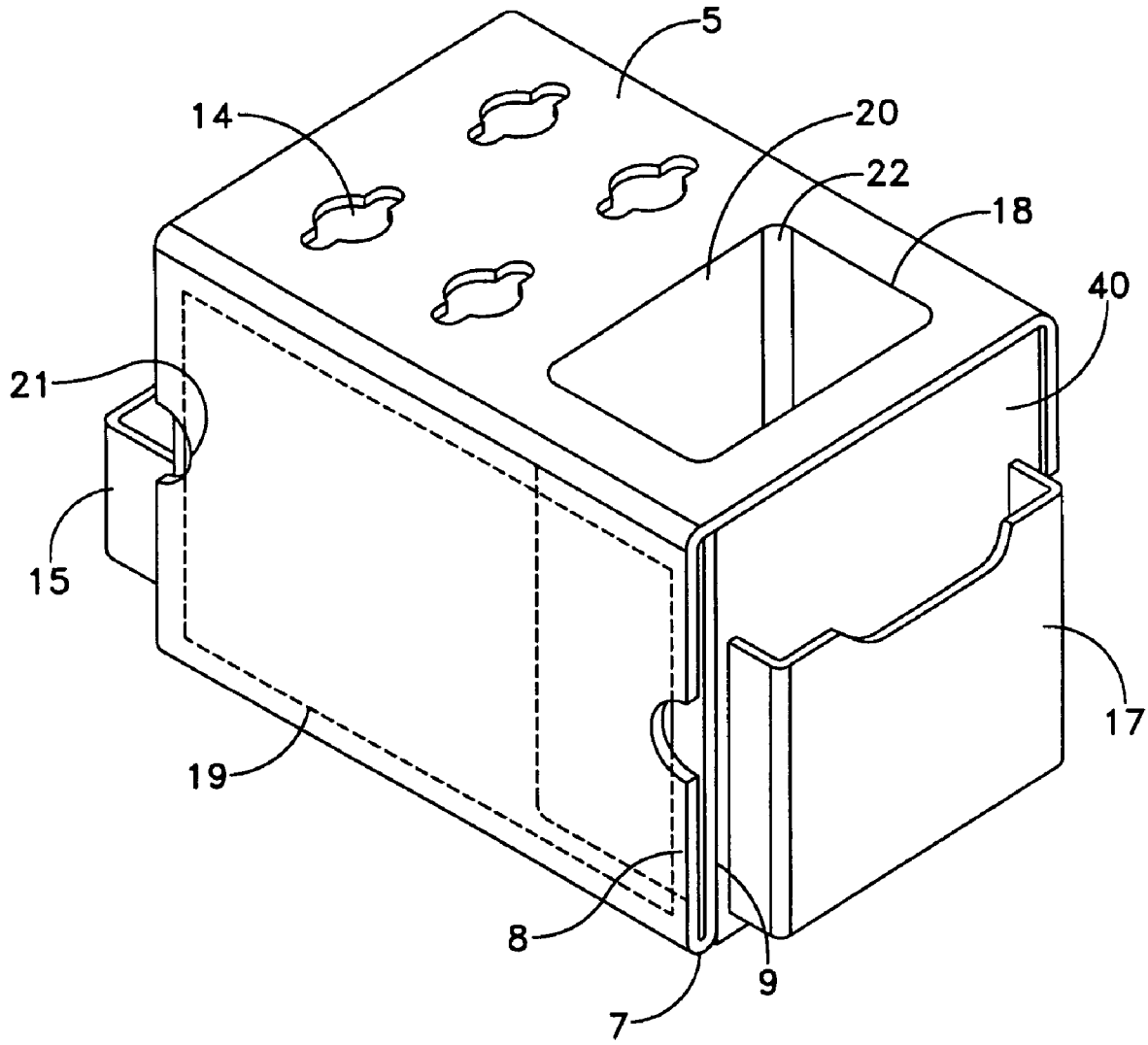
FIG. 2 is a top rear perspective view of an organizer device of the invention.

FIGS. 1 and 2 are top perspective views of an organizer 1, showing the front and rear ends of the device respectively, it being understood that the terms 'front' and 'rear' are assigned arbitrarily to refer to opposite ends of the device. Organizer 1 can be, e.g., a unit that is sized to fit easily on the surface of the work station of a hair stylist, e.g., approximately six inches long by four inches wide by four and a half inches tall. Organizer 1 can be, or can be assembled from, a frame or partial housing that includes top portion 5. Attached to and/or extending from the side edges of top portion 5 are two side portions. One or both of the sides can be constructed so that the side portion turns back on itself to form a U-shape structure 7. U-shape structure 7 forms sleeve 12 between an outer side surface, display surface portion 8, and an inner side surface, back surface portion 9. Preferably, display surface portion 8 is made from a material that is transparent, or at least translucent, to the eye.

The display organizer is provided with means for removably storing various instruments used by the operator. For this purpose, the horizontal top portion 5 serves as a shelf or deck that is provided with holes for receiving the instruments referred to, such as, without limitation, scissors. The instruments are put in position by merely inserting an end of each into one of the holes, and the instrument remains in position by gravity, although it may be in a tilted or canted position. The holes can be either apertures for receiving and storing objects in a 'standing up' position, e.g., aperture 14, or the holes can be openings such as receptacle opening 18 into containers or cups that are attached to the top portion 5. Various arrangements of apertures and container openings can be designed to fit the particular assortment of types of objects intended to be placed in the organizer.

Figure 7:
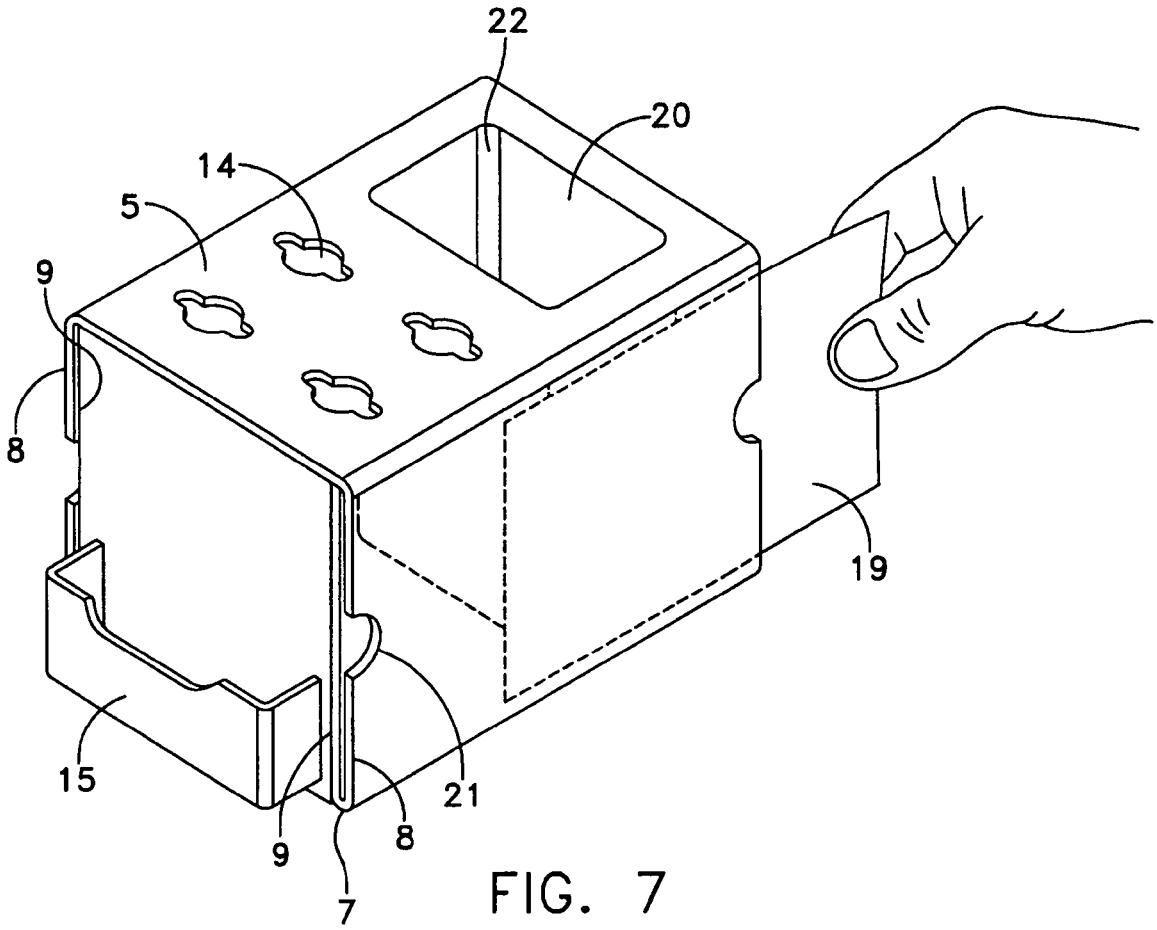
FIG. 7 is a perspective view, illustrating insertion by a user of a flat article into an organizer device of the invention.

Sleeve 12 is of a shape and size for receiving and holding a substantially flat item, display item 19, e.g., an item of paper, cardboard, or stiff cloth. In a preferred embodiment, display item 19 is a photograph, certificate, postcard, or the like, that can be viewed through display surface portion 8. The overall size and dimensions of organizer 1 can vary, and should be selected to accommodate a flat media of a predetermined size. As an example, the frame can be dimensioned to hold popular postcards or photographs, e.g., 3"×5" photographs, or 4"×6" photographs. For example, where an organizer is approximately six inches long by four inches wide by four inches tall, sleeve 12 can accommodate a display item 19 that is, e.g., a four inch by six inch photograph. The perspective view shown in FIG. 7 illustrates insertion by a user of a flat article into an organizer device of the invention.

Optionally, a recess can be cut in the wall of display surface portion 8 to form thumb indent 21, which facilitates inserting and removing display item 19 into and out of sleeve 12.

Figure 3:
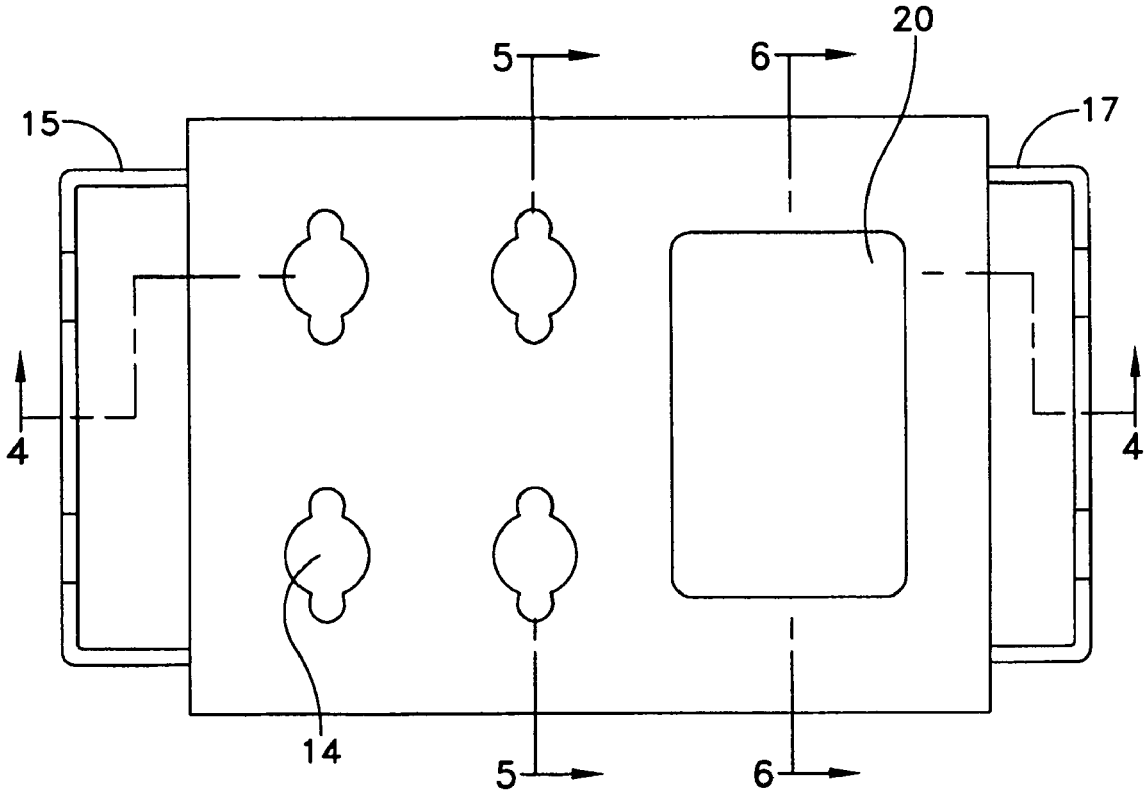
FIG. 3 is a plan view of an organizer device of the invention.

As shown in the plan view in FIG. 3, top portion 5 can further include one or more aperture(s) 14, having shapes and sizes chosen to fit a particular professional tool. For example, where the preferred tool is a pair of scissors, aperture 14 can have the shape shown in FIGS. 1, 2, and 3, which is designed to fit an inverted pair of hairstylist shears, the aperture 14 having 'ears' that allow scissors to be held snugly when slightly opened. In this case, aperture 14 is a hole of, e.g., ¾ inch, or preferably ⅝ inch.

The top surface of top portion 5 can further include one or more receptacle opening(s) 18 to serve as openings into receptacle 20. Receptacle 20 is a cup-like vessel for storing items such as writing implements, e.g., pens, pencils, markers, or other necessary implements. Although receptacle corners 22 are shown in FIGS. 1 and 2 with a round or curved shape, those skilled in the art will appreciate that the sides of receptacle 20 alternatively can join in an angled, e.g., a perpendicular, alignment to form a receptacle having squared off edges. Receptacle 20 can be formed as an integrally molded part of the frame of the organizer, such as that shown in FIG. 4, in which case receptacle opening 18 is formed by the downward recess of receptacle 20 from the top portion 5. Alternatively, receptacle opening 18 is a pre-cut opening in top portion 5, to which receptacle 20 can be attached at receptacle opening 18 by an adhesive to form a permanently adhered vessel. In yet another alternative embodiment (not shown), the top open edge of receptacle 20 can have a lip portion which is sufficiently wide to support receptacle 20 when receptacle 20 is set down into receptacle opening 18, the lip portion resting above and against opening 18.

Figure 4:
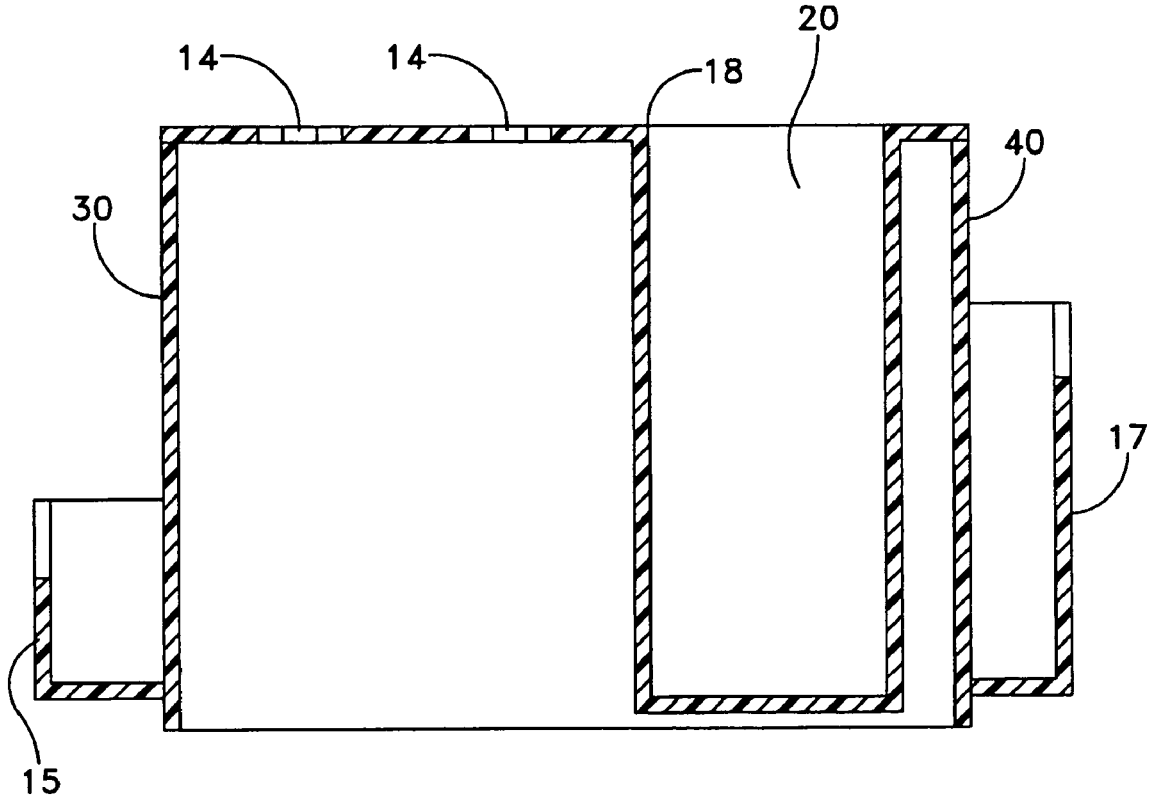
FIG. 4 is a view of section 4–4, as indicated in FIG. 3.
Figure 5:
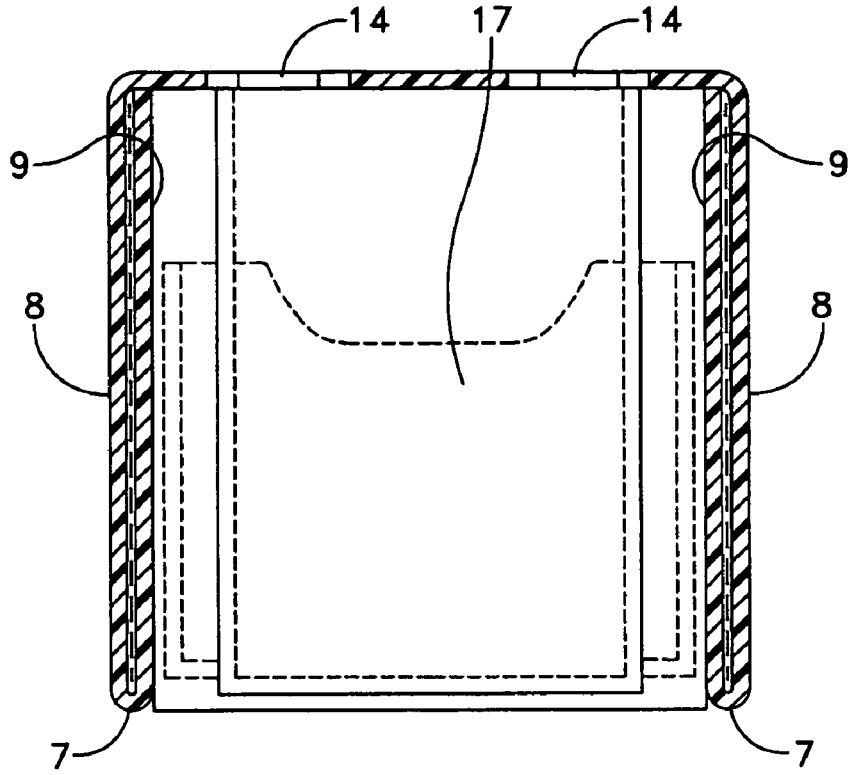
FIG. 5 is a view of section 5–5, as indicated in FIG. 3.
Figure 6:
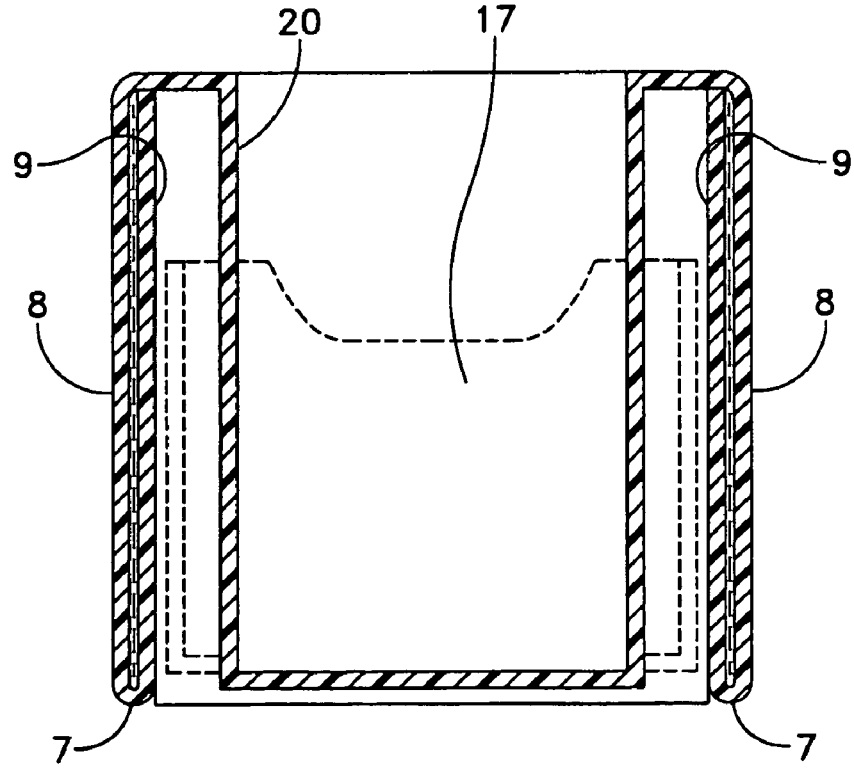
FIG. 6 is a view of section 6–6, as indicated in FIG. 3.

The frame of organizer 1 can further include end portions, arbitrarily referred to herein as front end portion 30 and rear end portion 40. One or both of the end portions can be formed as solid end caps to the frame, within back surface portion 9 of U-shaped structure 7. FIG. 4 is a view of section 4—4, as indicated in FIG. 3, showing front end portion 30 and rear end portion 40 attached to top portion 5 by, e.g., an adhesive.

Alternatively, end portions can be formed as the sides of another open box-like structure. The second open box-like structure, or "bottom frame," includes a front end portion 30, a rear end portion 40, and a bottom 50 (not shown). The bottom frame can be fit into a frame that includes top portion 5 and the two side portions ("top frame") to form housing for a display organizer of the invention.

The front and rear end portions can serve as panels to support various sizes and shapes of containers, e.g., one or more upwardly open container, cup, or trough. Containers are mounted in various numbers and locations, and different kinds and shapes of containers can be used. For example, compartment 15 can be of a size and shape suitable for holding business cards (FIGS. 1, 5, and 7), e.g., a rectangular cup-like business card holder. Holder 17 can be of a size and shape suitable for holding a pad of note paper, note book, address book, a personal data organizer (PDA), or other desired item (FIGS. 2, 7, and 9), e.g., a rectangular cup-like memo pad holder. Optionally, the open edges of compartment 15 or holder 17 can be given a decorative shape such as curves or fluting.

Preferably, the device of the invention is prepared from materials that result in products having a substantially firm, stiff, or rigid shape, such as acrylic or plastic, e.g., thermoplastic or thermoset plastic. Additional materials known to those skilled in the art can include glass, polycarbonate, polyethylene tetraphtalate glycol (PETG), Lexan® (General Electric Company Corporation, NY, N.Y.), or a form of polymethyl methacrylate (PMMA) such as, e.g., Plexiglass® (Rohm & Haas Company, Philadelphia, Pa.) or Lucite® (E. I. DuPont De Nemours And Company, Wilmington, Del.). Materials used in the invention can be clear or tinted.

Depending on the types of materials used for the housing, frame, receptacles or compartments, respectively, receptacles and compartments can be attached to the housing or frame by a heat weld, a solvent weld, a glue joint, an epoxy joint, a silicon joint or other types of heat, chemical or adhesive connection such as is well known by persons skilled in the art.

Preferably, the device, or at least that portion used to store a display item for viewing, is made from a material that is clear and transparent; or the device is clear and tinted with a color, e.g., black or grey tint, or other colors as known to those skilled in the art.

The device can be prepared by methods known by those skilled in the art, e.g., by injection molding, blow molding, or by a combination of machine processes and manual assembly. In another embodiment, a portion of the device is made by injection molding, and one or more additional portions of the device, e.g., a receptacle or pocket compartment, are then attached by a bonding technique. Suitable bonding techniques can include ultrasonic welding, hot air welding, or application with an adhesive, e.g., epoxy, glue, or solvent adhesive. For example, an injection molded piece can be formed having a shape that includes top portion 5 and the side portions, e.g., side portions having a U-shaped structure 7 to form display structures for holding photographs. To this piece is glued receptacle 20, e.g., an acrylic box shaped to hold pencils or other instruments. End caps are also glued to the frame. Holder 17 can be glued to end portion 40, e.g., as a container for cards or licenses. In other embodiments, one portion of the device can be prepared from, e.g., a translucent or opaque material, to which are adhered additional portions of the device, e.g., a compartment or receptacle intended for display of a photograph or other informational piece, that is prepared from a clear or transparent material.

In another optional embodiment, the interior space of a display organizer of the invention can be further enclosed by a bottom portion. For example, the organizer can be assembled from two pre-molded frames, a top frame and a bottom frame, one or both being a U-shaped structure. The top frame can encompass a storage sleeve on one or both side portions for a flat media to be displayed, such as a picture, a top portion having predetermined cut outs or openings for, e.g., attachment of a holder or receptacle to hold, e.g., pencils, and/or a slot for holding, e.g., scissors and/or other items that are deemed useful in a work setting (paper clip holder, stapler holder, letter opener, etc), and then the back picture sleeve. The bottom frame can encompass a flat base portion and front and rear ends. The top and bottom frames can be joined together by, e.g., thermal joining, or by using a solvent adhesive to join the two frames, forming a box shape apparatus. Any number and size of cup or container storage options can be affixed to the front or rear ends of the device, or, in the event that a flat media display sleeve is on only one of the side surfaces, to that side surface lacking a flat media display sleeve.

Another option is to embellish the device by adding a brand or label. The brand can be applied by thermal transfer, or 'hot stamp'. Alternative methods of applying a brand or label include etching, applying a colored material, e.g., silver or gold colored etching, or by laser etching. Without limitation, the brand or label can be a trademark or can be a UPC code by which the device can be scanned for inventory or retail purposes. (See, e.g., U.S. Pat. No. 6,531,208 B2, issued Mar. 11, 2003, hereby incorporated by reference.

EXAMPLE 1

One embodiment of the invention is directed to a device that serves as both an organizer and a display of professional tools and personal items for a beautician or hairstylist. Such a display organizer must be able to store a diverse assortment of hair styling, cosmetic, and related professional and personal accessories in a convenient but unobtrusive fashion. Preferably, the display organizer includes apertures, receptacles, and containers that are suitable for those items known to those skilled in the art to be desired by a professional during the work day, and permissibly displayed and stored in a display organizer of the invention according to any applicable local regulatory requirements. Clientele have a wide range of needs, so modern hair styling and cosmetology professionals are challenged to maintain equipment and other essentials in an efficient manner and a convenient, accessible location as they work. For example, during the course of an ordinary working day a beautician may desire to have available on his/her work station an assortment of varied hair styling accessories such as one or more of scissors, hair driers, razors, trimmers, clippers with variable sized blade attachments, tweezers, roller sets, and curling irons. The beautician would also desire to have available a stack of business cards, plenty of pens and pencils, a pad of paper or the like, a protective sleeve for a cosmetology license, and one or more favorite photographs. The display organizer of the invention can provide an organizational system for storing and displaying such items that is compact and attractive.

EXAMPLE 2

Another embodiment of the invention is directed to a device that serves as both an organizer and a display of professional tools and personal items for a draftsman. It can contain sleeve frames for storing photographs or other flat media, along with, e.g., a container for business cards, a container for a scientific calculator, and, from the top portion, could hold, e.g., a standard 7½ inch compass, a small shape triangle (landscape templates), a knife, e.g., an X-Acto® knife, and/or various rulers and pens, e.g., micron pens.

EXAMPLE 3

Yet another example of an embodiment of the invention is directed to a device that serves as both an organizer and a display of professional tools and personal items for an optician. It can contain sleeve frames for storing photographs or other flat media, along with, e.g., various sized compartments to hold various instrument used to adjust eyeglasses, e.g., slots for the basic types of pliers necessary to make adjustments, e.g., adjustment and nose pad pliers, cutting pliers, gripping and forming pliers, lens pliers, and semi rimless pliers, as well as containers for one or more optical screwdrivers and tweezers, calipers, cleaning fluids, and wipers or wipes.

The invention claimed is:

1. A display organizer comprising a) a frame having a substantially rigid shape and comprising a top portion having a substantially horizontal surface, two side portions having side surfaces and supported structurally by said top portion, and an interior space at least partially confined by said top portion and two side portions;

b) an opening in a limited area of said top portion, said opening configured to receive and hold an object within said interior space; and c) at least one of said side portions comprising an externally accessible media storage sleeve configured for viewable display of a flat media display item, wherein said at least one side portion comprises a display surface portion and a back surface portion, said back surface portion extending from said display surface portion and turned back toward said interior space to define said storage sleeve between said display surface portion and said back surface portion.

2. The display organizer of claim 1, wherein said opening is a receptacle opening, and said display organizer further comprises a receptacle within said interior space in object receiving communication with said receptacle opening.

3. The display organizer of claim 1, wherein said opening is an aperture configured to receive and hold an object within said interior space, said aperture further configured to support said object so as to maintain at least a portion of said object outside said interior space.

4. The display organizer of claim 3, wherein said object is maintained in a substantially upright position by said aperture.

5. The display organizer of claim 1, wherein said opening configured to receive and hold an object having a handle portion, and said opening is further configured to maintain said handle portion of said object outside said display organizer.

6. The display organizer of claim 5, wherein said opening is configured to receive and hold a pair of scissors.

7. The display organizer of claim 1, wherein said display organizer further comprises at least one end portion attached to said top portion and two side portions.

8. The display organizer of claim 7, wherein said display organizer further comprises an upwardly open container mounted on said end portion.

9. The display organizer of claim 8, wherein said container is a business card holder.

10. The display organizer of claim 1, wherein said display organizer further comprises a substantially planar bottom portion attached to said side portions.

11. The display organizer of claim 1, wherein said frame is a top frame and said display organizer further comprises a bottom frame, said bottom frame comprising a substantially planar bottom portion and two end portions, each end portion attached to one of said two ends of said bottom portion.

12. The display organizer of claim 11, wherein said display organizer further comprises an upwardly open container mounted on at least one of said end portions.

13. The display organizer of claim 1, wherein said opening is configured to receive and hold a writing instrument.

14. The display organizer of claim 1, wherein said storage sleeve comprises at least one slot sized to accept a sliding entry or exit of a flat media display item.

15. The display organizer of claim 1, wherein said storage sleeve comprises a translucent outer surface, whereby said flat media item within said storage sleeve is viewable through said outer surface.

16. The display organizer of claim 1, wherein said storage sleeve is configured for viewable display of a flat media display item chosen from the group consisting of a professional license and a professional certificate.

17. The display organizer of claim 1, wherein said storage sleeve is configured for viewable display of a flat media display item selected from the group consisting of a photograph and a postcard.

18. The display organizer of claim 1, wherein said storage sleeve is configured for viewable display of a flat media display item selected from the group consisting of a professional announcement and a professional schedule.

19. The display organizer of claim 1, wherein said frame is a molded frame.

20. The display organizer of claim 19, wherein said frame is a molded acrylic frame.

21. The display organizer of claim 1, wherein said storage sleeve comprises a transparent outer surface, whereby said flat media item within said storage sleeve is viewable through said outer surface.

22. A display organizer comprising a) a top frame having a substantially rigid shape and comprising a top portion having a substantially horizontal surface, two side portions having side surfaces and supported structurally by said top portion, and an interior space at least partially confined by said top portion and two side portions;

b) a slot opening in a limited area of said top portion, said opening configured to receive and hold an object within said interior space;

c) a receptacle opening in a limited area of said top portion, and a receptacle within the interior space configured to receive and hold an object through said receptacle opening within said interior space;

d) an end portion attached to said top portion and two side portions and supporting an upwardly open container; and e) at least one of said side portions comprising an externally accessible media storage sleeve configured for viewable display of flat media, wherein said at least one side portion comprises a display surface portion and a back surface portion, said back surface portion extending from said display surface portion and turned back toward said interior space to define said storage sleeve between said display surface portion and said back surface portion.

* * * * *